US009168980B1

(12) United States Patent
Falck

(10) Patent No.: US 9,168,980 B1
(45) Date of Patent: Oct. 27, 2015

(54) ADJUSTABLE AIR SHOCK BOAT SEAT PEDESTAL

(71) Applicant: Lee Falck, Forest Lake, MN (US)

(72) Inventor: Lee Falck, Forest Lake, MN (US)

( * ) Notice: Subject to any disclaimer, the term of this patent is extended or adjusted under 35 U.S.C. 154(b) by 114 days.

(21) Appl. No.: 13/946,600

(22) Filed: Jul. 19, 2013

Related U.S. Application Data

(60) Provisional application No. 61/741,414, filed on Jul. 20, 2012.

(51) Int. Cl.
*B63B 17/00* (2006.01)

(52) U.S. Cl.
CPC ..... *B63B 17/0081* (2013.01)

(58) Field of Classification Search
USPC ..... 114/363; 297/344.16
IPC ..... B60N 5/525,5/257; B63B 2029/043
See application file for complete search history.

(56) References Cited

U.S. PATENT DOCUMENTS

| | | | | |
|---|---|---|---|---|
| 5,465,679 | A | 11/1995 | Mardikian | |
| 5,911,191 | A * | 6/1999 | Burer | 114/363 |
| 6,182,590 | B1 | 2/2001 | Patera | |
| 6,880,483 | B2 | 4/2005 | Fedders | |
| 7,549,387 | B2 | 6/2009 | Funk | |
| 2012/0098175 | A1* | 4/2012 | Wu | 267/132 |
| 2013/0118847 | A1* | 5/2013 | Krahenbuhl et al. | 188/313 |

* cited by examiner

*Primary Examiner* — Stephen Avila
(74) *Attorney, Agent, or Firm* — Simmons Perrine Moyer Bergman PLC

(57) ABSTRACT

The present invention includes a boat having a seat with a pneumatically adjustable passenger ride-height, for a given passenger and/or an adjustable passenger weight range for a given ride height range and with an adjustable rebound damping mechanism, where adding air results in a lifting of the seat, and rotating a member results in change of the rebound speed.

16 Claims, 3 Drawing Sheets

ADJUSTABLE AIR SHOCK BOAT SEAT PEDESTAL

FIELD OF THE INVENTION

The present invention relates to improved systems and methods for supporting a boat seat.

BACKGROUND OF THE INVENTION

The present invention relates generally to a ride-height and/or passenger weight adjustable shock absorbing boat seat pedestal, and methods of constructing and utilizing same.

More particularly, the present invention relates to a shock absorbing boat seat pedestal which uses an air filled portion, and liquid and gaseous matter combination filled portion, and methods of constructing and utilizing same.

The prior art includes at least the following U.S. patents:

U.S. Pat. No. 5,465,679 issued in 1995 to Mardikian entitled "PERSONAL WATERCRAFT AND BOAT WITH SHOCK ABSORBING FLOORBOARDS;"

U.S. Pat. No. 6,182,590 issued in 2001 to Patera entitled "PERSONAL WATERCRAFT SUSPENSION SYSTEM;"

U.S. Pat. No. 6,880,483 issued in 2005 to Fedders entitled "ACTIVE SEAT SUSPENSION FOR WATERCRAFT;" and U.S. Pat. No. 7,549,387 B 2 issued on Jun. 23, 2009 to James Joseph Funk entitled "SHOCK ABSORBING SEAT PEDESTAL."

While these prior art methods have been known in the past and may have provided some utility to persons sitting in boat seats, they do have several problems, some of which are overcome by the present invention.

SUMMARY OF THE INVENTION

It is an object of the present invention to provide a comfortable ride to persons sitting in a boat seat.

It is a feature of the present invention to include a ride-height adjustable pneumatic boat seat pedestal.

It is an advantage of the present invention to provide for simultaneous and independent ride-height adjustment and rebound speed damping adjustment.

The present invention is designed to achieve the above mentioned objectives, include the previously stated features, and provide the aforementioned advantages.

The present invention comprises:

A seating system for supporting a person in an adjustable elevated position above a lower portion of a boat, where the seating system comprises:

a boat seat having a bottom portion;

a boat seat base portion configured to couple with said bottom portion of said boat seat;

a base member portion configured to couple with a portion of a boat, which is generally lower than a predetermined boat seat height;

an adjustable length pedestal disposed between said boat seat base portion and said base member portion, said adjustable length pedestal comprising:

a first tube;

a second tube; said second tube at least partially nested within said first tube;

an air chamber disposed wholly within one of said first tube and said second tube;

an oil chamber disposed wholly within another of said first tube and said second tube; said oil chamber being variably disposed within said one of said first tube and said second tube;

a piston disposed wholly within said oil chamber and coupled to a portion of said one of said first tube and said second tube;

means for introducing pressurized air into said air chamber where an increase in air pressure in said air chamber results in an upward adjustment of a ride-height of said boat seat, until a maximum seat height is reached; and means for adjustably restricting an oil flow rate from one side of said piston to another side of said piston and thereby adjustably limiting a rebound rate of said piston after a temporary force applied to said boat seat pedestal is reduced.

Other objectives, advantages and features of the invention will become apparent to those persons skilled in this particular area of technology, and to other persons, after having been exposed to the following detailed description, when read in conjunction with the accompanying patent drawings.

DETAILED DESCRIPTION OF THE INVENTION

Figure 1:
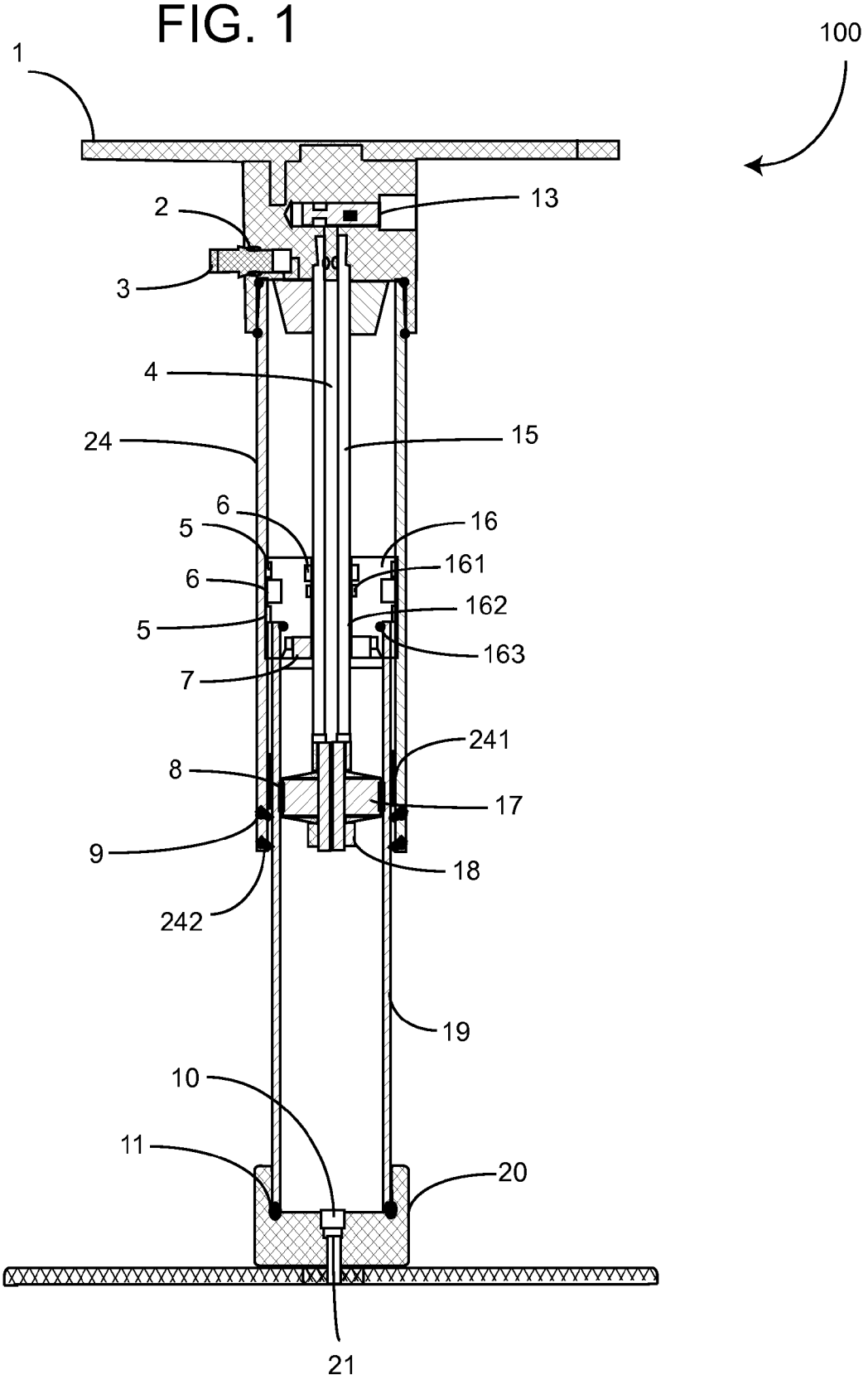
FIG. 1 is a cross-sectional view of a shock absorber boat seat pedestal in accordance with the invention.

Now referring to the drawings wherein like numerals refer to like structure shown in the drawings and text included in the application throughout. With reference to FIG. 1, there is shown a boat seat pedestal of the present invention generally designated 100 which includes a seat base 1 a Schrader valve 3 with an adjacent o-ring 2. Schrader valve 3 is provided as an input location for air into the air compartment of the upper tube 24. A high pressure air source 33 (FIG. 3) could be a manual air pump, an electric air pump, a reserve air tank or other source of pressurized air, which could be coupled to the Schrader valve 3, or it could replace the Schrader valve 3 in some applications. Inside of upper tube 24, running from an upper location to a lower location, is a hollow shaft 15 with a rebound metering rod 4 disposed therein. In some embodiments, the hollow shaft 15 could be replaced with a solid shaft, and rebound adjustment would be omitted from involvement with the shaft coupled to the piston 17.

Figure 3:
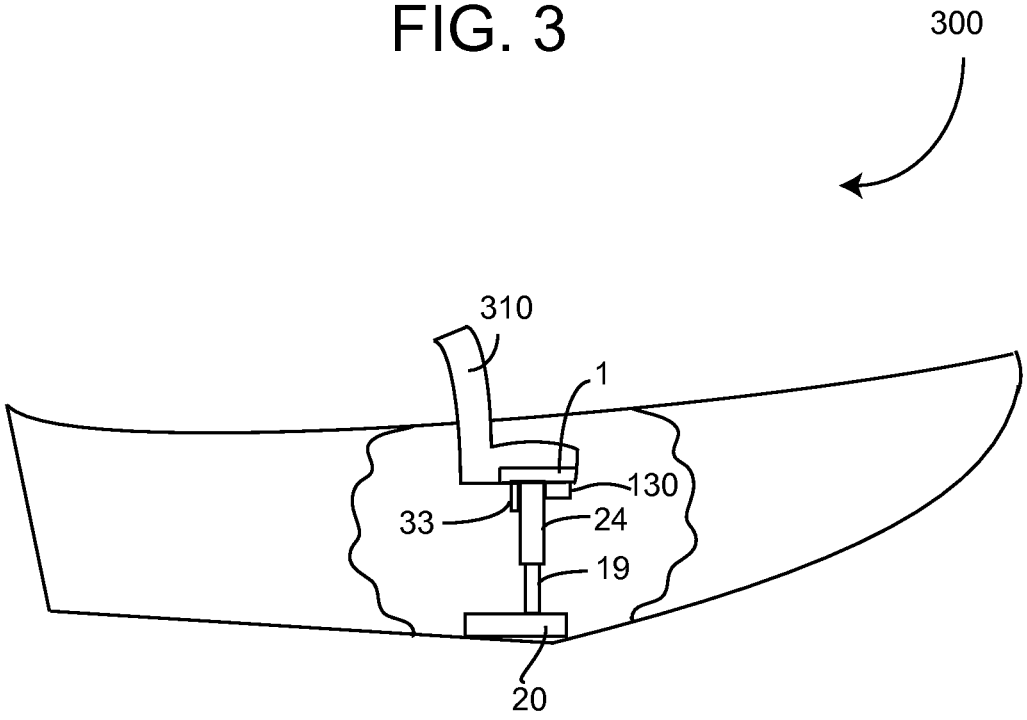
FIG. 3 is a cut-away elevation view of a boat of the present invention, exposing a variant of the pedestal of FIG. 1 and FIG. 2.

A lower tube or body 19 is disposed near a base 20, which is attached to the boat 300 of FIG. 3. Disposed within body 19 is a piston 17, which is coupled to and moves up and down with shaft 15. Metering rod 4 forms, or controls, a portion of a valve which regulates the rate at which fluid can flow from one side of the piston to another side. This regulation of flow rate is a rebound adjustment, which is adjusted by rebound adjuster 13, which manipulates a top portion of the rebound metering rod 4. Additionally, variable sized holes may be located through the piston so that flow rate corresponds to hole size. Hole size may be changed by inserting sleeves, shims, partial plugs etc. Placed atop the body 19 and inside the upper tube 24 is bearing assembly 16, which is affixed to the body 19 and separates the upper (inside upper tube 24) and lower (inside body 19) fluid chambers. Bearing assembly allows the upper tube to pass by and allows the shaft 15 to pass therethrough. Bearing 5 and 162; seal 6 and o-rings 161 and 163 are shown. A bumper 7 is also shown which performs the function of preventing metal on metal collisions.

Piston 17 has a piston bearing 8 and a nut 18. At the lower end of the upper tube 24, there is a bearing 241, a wiper seal 9 and an end seal 242.

The body 19 is designed to retain oil and nitrogen, and an O ring 11 is shown as a seal, also there is a retainer 10 which holds a rubber pill 21 through which nitrogen can be added when necessary.

Figure 2:
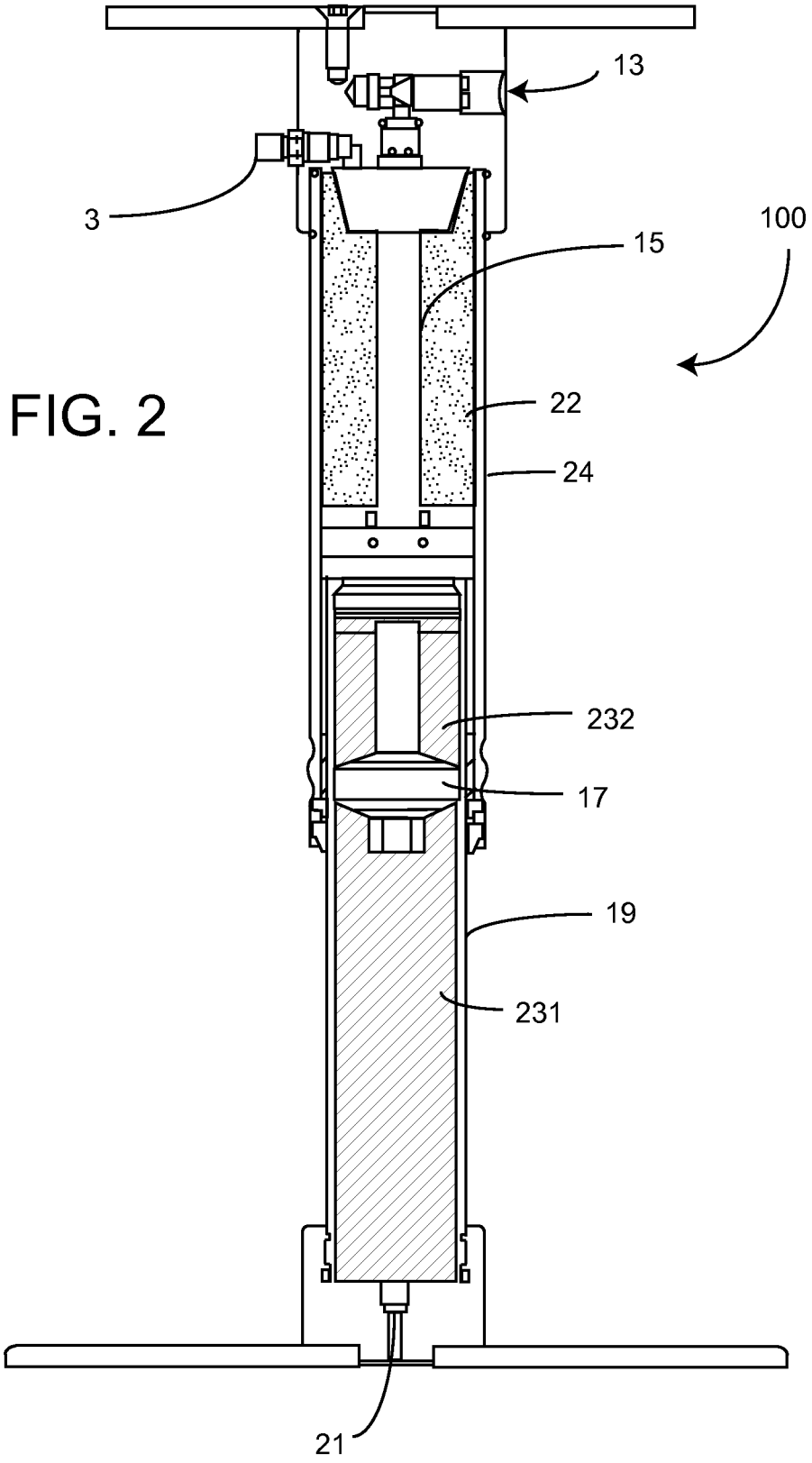
FIG. 2 is a cross-sectional view of a first embodiment of the invention including the optional external reservoir.

Now referring to FIG. 2, there is shown the pedestal 100 of FIG. 1 with oil and nitrogen in the oil chamber 23 body 19 and air in the air chamber 22 in upper tube 24. The oil chamber 23 may be filled with just oil and a reservoir can be provided to allow oil to escape as more of the shaft 15 moves downward into the body 19. The oil chamber is divided into upper variably sized oil chamber 232 and a lower variably sized oil chamber 231. As the piston goes down, such as in response to a person sitting down on the seat or the boat hitting a wave; the volume in upper variably sized oil chamber 232 is increasing and therefore has decreasing pressure, therefore the oil passes through the holes in piston 17 and/or through the valve opening variably created by the bottom end of metering rod 4 (FIG. 1). If the jolt from the wave is particularly large, the speed at which the piston travels downward will be limited by how quickly the oil can pass through the holes in the piston and the valve. Similarly, the maximum rate of flow of oil will restrict the speed at which the piston 17, and therefore the seat base 1 and boat seat rebound to being fully extended. The adjustment of rebound adjuster 13 therefore sets the amount of damping of the air shock which is formed by air chamber 22.

Now referring to FIG. 3, there is shown a boat 300 with a variation of the pedestal 100 which has an air pressure input source 33 at the site of the Schrader valve 3 of FIGS. 1 and 2, and a rebound adjusting knob 130 at the site of the rebound adjuster 13. A seat 310 is disposed atop the upper tube 24.

Now referring to FIGS. 1 through 3, and in operation, the air pressure within air chamber 22 is increased and thereby the ride height is increased for a given passenger or the ride height is maintained for a heavier passenger, and when a person sits on the seat, the seat base goes down, the other tube 24 passes over more of the inner tube 19, the size of the air chamber 22, which is defined by the space inside the outer tube 24, which is above the bearing assembly 16, decreases. The lower variably sized oil chamber is caused to decrease in volume proportional with a decrease in the air chamber volume Although the invention has been described in detail in the foregoing only for the purpose of illustration, it is to be understood that such detail is solely for that purpose and that variations can be made therein by those of ordinary skill in the art without departing from the spirit and scope of the invention as defined by the following claims, including all equivalents thereof.

It is thought that the method and apparatus of the present invention will be understood from the foregoing description, and that it will be apparent that various changes may be made in the form, construct steps, and arrangement of the parts and steps thereof, without departing from the spirit and scope of the invention, or sacrificing all of their material advantages. The form herein described is merely a preferred exemplary embodiment thereof.

What is claimed is:

1. A seating system for supporting a person in an adjustable elevated position above a lower portion of a boat, where the seating system comprises:

a boat seat having a bottom portion;

a boat seat base portion configured to couple with said bottom portion of said boat seat;

a base member portion configured to couple with a portion of a boat, which is generally lower than a predetermined boat seat height;

an adjustable length pedestal disposed between said boat seat base portion and said base member portion, said adjustable length pedestal comprising:

a first tube;

a second tube; said second tube at least partially nested within said first tube;

an air chamber disposed wholly within one of said first tube and said second tube;

an oil chamber disposed wholly within another of said first tube and said second tube; said oil chamber being variably disposed within said one of said first tube and said second tube;

a piston disposed wholly within said oil chamber and coupled to a portion of said one of said first tube and said second tube;

means for introducing pressurized air into said air chamber where an increase in air pressure in said air chamber results in an adjustment of support provided for said boat seat, and means for adjustably restricting an oil flow rate from one side of said piston to another side of said piston and thereby adjustably limiting a rebound rate of said piston after a temporary force applied to said boat seat pedestal is reduced.

2. The system of claim 1 wherein said first tube is proximal to said boat seat.

3. The system of claim 2 wherein said oil chamber is filled with oil and nitrogen gas.

4. The system of claim 2 wherein said means for adjustably restricting an oil flow rate is adjustable from a location above a top portion of said oil chamber.

5. The system of claim 4 wherein said means for adjustably restricting further comprises a valve, which is at least partially disposed within a hollow shaft supporting said piston.

6. The system of claim 5 wherein said oil chamber is filled with a fluid comprising oil and nitrogen gas.

7. A seating system for supporting a person in an adjustable elevated position above a lower portion of a boat, where the seating system comprises:

a boat seat having a bottom portion;

a boat seat base portion configured to couple with said bottom portion of said boat seat;

a base member portion configured to couple with a portion of a boat, which is generally lower than a predetermined boat seat height;

an adjustable length pedestal disposed between said boat seat base portion and said base member portion, said adjustable length pedestal comprising:

a first tube;

a second tube; said second tube at least partially nested within said first tube;

an air chamber disposed wholly within said first tube;

an oil chamber disposed wholly within said second tube; said oil chamber also being variably disposed within said first tube;

a piston disposed wholly within said oil chamber and coupled to a portion of said one of said first tube;

means for introducing pressurized air into said air chamber where an increase in air pressure in said air chamber results in an increase in one of: ride-height of said boat seat for a given passenger or an increase in passenger weight for a given ride height;

wherein said piston is coupled by a shaft through said air chamber with said first tube;

wherein said shaft is a hollow shaft; and means for adjustably restricting an oil flow rate from one side of said piston to another side of said piston and thereby adjustably limiting a rebound rate of said piston after a temporary force applied to said boat seat pedestal is reduced.

8. The system of claim 7 wherein said hollow shaft comprises a rebound metering rod.

9. The system of claim 8 wherein said rebound metering rod mates with a rebound adjuster so that turning of said rebound adjuster results in opening and closing of a valve, where a portion of the valve comprises a portion of said rebound metering rod.

10. A seating system for supporting a person in an adjustable elevated position above a lower portion of a boat, where the seating system comprises:

a boat seat having a bottom portion;

a boat seat base portion configured to couple with said bottom portion of said boat seat;

a base member portion configured to couple with a portion of a boat which is generally lower than a predetermined boat seat height;

an adjustable length pedestal disposed between said boat seat base portion and said base member portion, said adjustable length pedestal comprising:

a first tube;

a second tube; said second tube at least partially nested within said first tube;

an air chamber disposed wholly within said first tube;

an oil chamber disposed wholly within said second tube; said oil chamber also being variably disposed within said first tube;

a piston disposed wholly within said oil chamber and coupled to a portion of said one of said first tube by a shaft extending through said air chamber;

means for adjusting a ride-height of said boat seat, until a maximum seat height is reached; and means for adjustably limiting a rebound rate of said piston after a temporary force applied to said boat seat pedestal is reduced.

11. The system of claim 10 wherein said means for adjusting a ride-height comprises an input port for a pressurized fluid.

12. The system of claim 11 wherein said means for adjustably limiting comprises a means for regulating flow of fluid from one side of said piston to another side of said piston.

13. The system of claim 12 wherein said means for regulating comprises a means for manipulating a metering rod disposed with said shaft.

14. The system of claim 13 wherein said means for adjusting a ride-height is configured to provide a means for maintaining a given ride height for a passenger of a different weight.

15. The system of claim 7 wherein said means for introducing consists of a Schrader valve.

16. The system of claim 10 wherein said means for adjusting a ride-height consists of a Schrader valve.

* * * * *